US005405093A

United States Patent [19]

Bozarth

[11] Patent Number: 5,405,093

[45] Date of Patent: Apr. 11, 1995

[54] DISPOSAL SYSTEM FOR WASTE MATERIAL

[75] Inventor: Harold Bozarth, Topeka, Ind.

[73] Assignee: Environmental Waste Reduction Systems, Inc., Topeka, Ind.

[21] Appl. No.: 164,907

[22] Filed: Dec. 10, 1993

[51] Int. Cl.[6] ..... B02C 25/00

[52] U.S. Cl. ..... 241/34; 241/65; 241/242; 241/280

[58] Field of Search ..... 241/33, 34, 36, 60, 241/63, 65, 86, 79.1, 224, 242, 280, 281

[56] References Cited

U.S. PATENT DOCUMENTS

| | | | |
|---|---|---|---|
| 1,214,558 | 2/1917 | Liggett | 241/280 |
| 1,348,659 | 8/1920 | Nicholson et al. | 241/280 |
| 2,172,886 | 9/1939 | Gabel | 241/224 |
| 2,962,234 | 11/1960 | Ávila | 241/280 X |
| 3,236,723 | 2/1966 | Whiteside | 241/224 X |
| 3,904,135 | 9/1975 | Bogie | 241/86 |
| 3,922,975 | 12/1975 | Reese | 241/65 X |
| 4,709,197 | 11/1987 | Goldhammer et al. | 241/36 X |
| 4,793,561 | 12/1988 | Burda | 241/36 |
| 4,844,363 | 7/1989 | Garnier et al. | 241/224 |
| 5,052,630 | 10/1991 | Hinsey et al. | 241/36 |

*Primary Examiner*—Timothy V. Eley

*Attorney, Agent, or Firm*—Ernest U. Lang

[57] ABSTRACT

A disposal system 1 for waste material comprising independently integrated shredding 2, storage 3, and furnace 4 systems. A first transportation system 5, controlled by the shredding system, transports material to the storage system which has capacity that permits repeated shredding cycles with no furnace cycle. A second transportation system 6, controlled by the furnace system, removes material from the storage system at a rate satisfying the output heat demand 7 of the furnace system. The shredder 19 has a hopper 20 with three vertical sides, 9 10, and 11, and a fourth inclined side 12 with a blade 13 at its lowest end. A single rotating member 14 cooperates with the blade. A pusher 15, acting along the inclined side, dislodges any bridging in the hopper. A grate 16 receives the shredded material and cooperates with the rotating member for further shredding. There is a magnetic separator 17. A blower 8 then provides further shredding as it propels the shredded material, in a stream of air, to the storage system. The hydrostatic drive 18 for the shredder inversely adjusts the rotational speed to the shredding load. If the rotating member stalls, the drive first reverses and then rotates normally.

7 Claims, 1 Drawing Sheet

DISPOSAL SYSTEM FOR WASTE MATERIAL

BACKGROUND OF THE INVENTION

U.S. Pat. No. 4,995,324 discloses a form of storage provided by a conveyor which can be made any length to provide minutes of storage prior to a shredder.

U.S. Pat. No. 5,207,390 discloses a shredder drive varying the rate of shredding by observing a feeding section. A further disclosure takes into account not only the quantity of refuse but the drive current value of the shredder drive motor.

SUMMARY OF THE INVENTION

Since leasing of equipment has become a popular decision, an object of the invention is to provide readily transportable modules i.e. independently integrated shredding, storage, and furnace sections each connected by suitable transportation means.

Furthermore it is desirable to be able to shred waste material at times when it is not desirable to operate the furnace section. An object of the invention is to provide a storage system which has capacity that permits repeated shredding cycles with no furnace cycles. Likewise it is an object of the invention to provide waste material to the furnace section when there is no waste material to shred.

Some industries, such as the recreational vehicle and mobile home industry, produce waste combustible materials readily handled and shredded by a shredder essentially comprising a hopper with three substantially vertical sides and another inclined side with a blade positioned at its lowest end and a single rotating member with teeth cooperating with the blade.

DRAWINGS

PREFERRED EMBODIMENT

Figure 1:
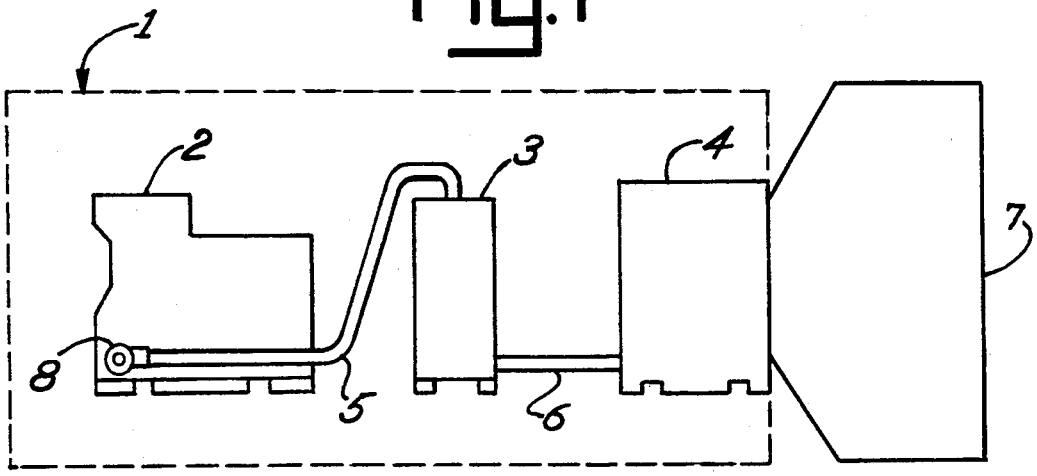
FIG. 1 shows the overall arrangement of the invention.
Figure 2:
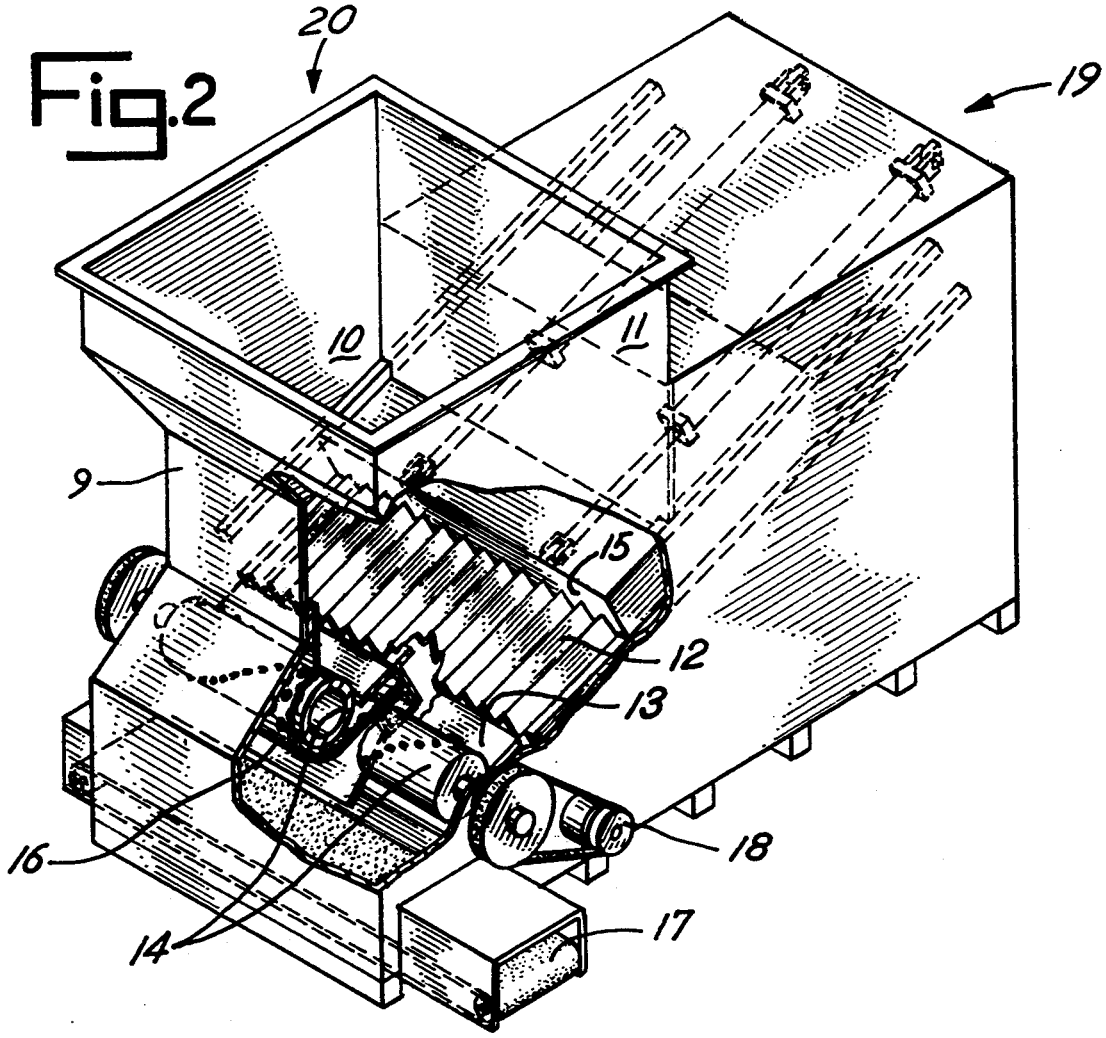
FIG. 2 shows in detail the shredder system of the invention.

The preferred embodiment comprises a disposal system 1 for waste material comprising integrated shredding 2, storage 3, and furnace 4 systems wherein a first transportation system 5 is controlled by the shredding system and transports material to the storage system, and a second transportation system 6 is controlled by the furnace system to meet the heat demand 7 output of the furnace system by removing material from the storage system and depositing it in the furnace system, and wherein the storage system has capacity that permits repeated shredding cycles with no furnace cycles or repeated furnace cycles with no shredding cycles. A shredding cycle spans the time from when the shredder drive is activated until the blower 8 is deactivated. A furnace cycle spans the time from when the heat demand demands heat until the furnace satisfies the heat demand.

The shredder 19 of the shredding system comprises a hopper 20 with three substantially vertical sides 9, 10, 11 (cut away) and a fourth inclined side 12 with a blade 13 positioned at its lowest end, and a single rotating member 14 with teeth that cooperate with the blade by passing in close proximity. A grate 16 is positioned to receive the shredded material and cooperate with the rotating member to further shred the waste material. A magnetic separator 17 then removes magnetic material.

Blower 8 of the first transportation system has blades that impact and further shred the waste material as it propels the shredded material to the storage system. The blower is activated when the shredder is activated and stays activated for a fixed time after the shredder is deactivated.

To insure that all material that is deposited into the hopper is shredded as efficiently as possible, a pusher 15 with a sawtooth bottom on its face which cooperates with a mating surface on the inclined side, acting along the inclined side, dislodges any bridged material such as material slightly longer than the width of the hopper which becomes wedged between the side walls, and the drive 18 for the rotating member automatically inversely adjusts the rotational speed to the shredding load. If the rotating member stalls, the drive reverses the rotating member and then rotates normally. If, after sensing no load and operating the pusher there is still no load, the drive is shut off.

OPERATION

As waste material accumulates it is deposited into the hopper of the shredder. A four-sided extension to the hopper extends upward to stabilize any long pieces and also provide more accumulation of smaller pieces. When there is sufficient material in the hopper the shredder system is energized by the operator. If the drive indicates no load the pusher moves down the inclined side to dislodge any bridging. If the drive stalls it reverses and then rotates normally. When the hopper is empty no load is sensed, the pusher is activated, no load is again sensed, and the drive shuts itself off after enough time for the material to clear past the blower.

The magnetic separator is standard equipment, i.e., a magnetic pulley around which a belt passes. The belt extends across the shredder and receives the shredded material as it comes through the grate. A feature is the reversible drive for the magnetic separator. When nonflammable material is shredded, such as gypsum board, the drive is reversed and the shredded material is disposed of separately on the opposite side of the shredder from the shredded flammable material.

The storage system passively accumulates the shredded material.

When output heat is demanded from the furnace system, material is removed from the storage system and deposited in the furnace system at a rate that satisfies the heat demand.

I claim:

1. A disposal system (1) for waste material, primarily consisting of combustible materials, comprising independently integrated shredding (2), storage (3), and furnace (4) systems wherein a first transportation system (5), controlled by the shredding system, transports material to the storage system, a second transportation system (6), controlled by the furnace system, removes material at a controlled rate from the storage system and deposits it in the furnace system to meet an output heat demand (7), and wherein the storage system has capacity that permits repeated shredding cycles with no furnace cycle or repeated furnace cycles with no shredding cycles.

2. The disposal system of claim 1 wherein said first transportation system propels shredded material in a stream of air provided by a blower (8) which provides additional shredding.

3. The disposal system of claim 1 wherein the shredding system includes a shredder for waste material comprising a hopper 20 with three substantially vertical sides (9), (10), (11), and an inclined side (12) with a blade 13 positioned at the inclined side's lowest end, and also comprising a single rotating member (14) with teeth that cooperate with the blade and a pusher 15 acting along the inclined side for dislodging any bridging of the waste material as indicated by a no load condition of drive 18 of the shredder while the shredder is activated.

4. A shredder for waste material comprising a hopper (20) with three substantially vertical sides (9), (10), (11) and an inclined side (12) with a blade (13) positioned at the inclined side's lowest end, and also comprising a single rotating member (14) with teeth that cooperate with the blade and a pusher 15 acting along the inclined side for dislodging any bridging of the waste material as indicated by a no load condition of drive 18 of the shredder while the shredder is activated.

5. The shredder of claim 4 further comprising a grate (16) positioned to receive the shredded material and cooperate with the rotating member to further shred said waste material.

6. The shredder of claim 4 further comprising a magnetic separator (17) including a reversible belt for collecting shredded waste material and separating noncombustible from combustible waste material.

7. The shredder of claim 4 wherein a face of the pusher has a sawtooth bottom which cooperates with a mating surface of the inclined side.

* * * * *